US008528768B2

(12) United States Patent
D'Amato

(10) Patent No.: US 8,528,768 B2
(45) Date of Patent: Sep. 10, 2013

(54) RECLOSEABLE LID FOR A CONTAINER, IN PARTICULAR FOR A PAPER CUP

(75) Inventor: Gianfranco D'Amato, Arzano Napoli (IT)

(73) Assignee: Seda S.p.A., Arzano Napoli (IT)

( * ) Notice: Subject to any disclaimer, the term of this patent is extended or adjusted under 35 U.S.C. 154(b) by 5 days.

(21) Appl. No.: 13/063,345

(22) PCT Filed: Oct. 13, 2008

(86) PCT No.: PCT/EP2008/008650

§ 371 (c)(1),
(2), (4) Date: May 5, 2011

(87) PCT Pub. No.: WO2010/028677

PCT Pub. Date: Mar. 18, 2010

(65) Prior Publication Data

US 2011/0198351 A1 Aug. 18, 2011

(30) Foreign Application Priority Data

Sep. 12, 2008 (DE) ..... 20 2008 012 116 U

(51) Int. Cl.
*B65D 51/18* (2006.01)

(52) U.S. Cl.
USPC ..... 220/253; 220/254.8; 220/259.5

(58) Field of Classification Search
USPC ..... 220/253, 254.8, 254.1, FOR. 203, 220/713, 711, 705, 354.4, 354.1, 259.5, 259.4, 220/259.3, 256.1, 200; 229/404; 222/560
See application file for complete search history.

(56) References Cited

U.S. PATENT DOCUMENTS

| | | | | | |
|---|---|---|---|---|---|
| 30,266 | A * | 10/1860 | Towers | 220/253 |
| 1,714,368 | A * | 5/1929 | Hobson | 222/553 |
| 2,723,072 | A * | 11/1955 | Sayford, Jr. | 229/5.5 |
| 2,956,721 | A * | 10/1960 | Bennett | 229/404 |
| 3,402,847 | A * | 9/1968 | Bridenstine | 220/253 |
| 4,643,881 | A * | 2/1987 | Alexander et al. | 422/265 |
| 5,072,849 | A * | 12/1991 | Blau | 220/253 |
| 6,003,711 | A * | 12/1999 | Bilewitz | 220/253 |
| 6,305,571 | B1 * | 10/2001 | Chu | 220/719 |
| 6,732,875 | B2 * | 5/2004 | Smith et al. | 220/253 |
| 7,156,251 | B2 * | 1/2007 | Smith et al. | 220/253 |
| 7,159,732 | B2 * | 1/2007 | Smith et al. | 220/253 |
| 2003/0024929 | A1 * | 2/2003 | Smith et al. | 220/253 |

FOREIGN PATENT DOCUMENTS

| | | |
|---|---|---|
| WO | 03047994 | 6/2003 |
| WO | WO2003013969 A3 | 4/2004 |
| WO | 2005016778 | 2/2005 |
| WO | 2006039044 | 4/2006 |

* cited by examiner

*Primary Examiner* — Robert J Hicks
(74) *Attorney, Agent, or Firm* — Fish & Richardson P.C.

(57) ABSTRACT

The invention is directed to a lid for a container, in particular to a lid for a drink container such as a paper cup. The lid is detachably mountable onto the edge of an opening of the container. The lid comprises a lower lid part with an inner outlet opening, and an upper lid part with an outer outlet opening. In an assembled position, the upper lid part is mounted rotatable relative to the lower lid part between at least two positions, such that the outlet openings are mutually aligned in one position and are without any overlap in the other position. The lower lid part has a circumferential mounting flange for overlapping the opening edge of the container, and the upper lid part has a circumferential mounting flange for overlapping the mounting flange of the lower lid part.

24 Claims, 3 Drawing Sheets

RECLOSEABLE LID FOR A CONTAINER, IN PARTICULAR FOR A PAPER CUP

CROSS REFERENCE TO PRIOR APPLICATIONS

This is a U.S. National Phase application under 35 U.S.C. §371 of International Patent Application No. PCT/EP2008/008650, filed Oct. 13, 2008, and claims the priority of German Patent Application No. 202008012116.7, filed Sep. 13, 2008, both of which are incorporated by reference herein. The International Application published in English on Mar. 18, 2010 as WO WO2010/028677 under PCT Article 21(2).

The present invention concerns a reclosable lid for a container, in particular for a container comprising liquid drinks, such as a paper cup or the like. The lid can be opened, and it can be reclosed after consumption of part of the drink by the user. For this purpose, the lid is assembled from a lower lid part and an upper lid part that may be rotated with respect to the lower lid part in order to open or close an outlet opening.

BACKGROUND OF THE INVENTION

Such a reclosable "double lid," i.e. a lid comprising an upper and a lower lid part, is known from U.S. Pat. No. 7,159,732. In this conventional lid, the upper lid part is mounted on the edge of a consumption opening on a container. A considerably smaller, lower lid part is arranged below the top surface of the outer lid part. The lower lid part comprises a pin projecting through a hole in the upper lid part. By gripping this pin, the user may rotate the lower lid part relative to the upper lid part in order to open or close a consumption opening of the upper lid part. Similar lids are also disclosed in WO 2003/013969 A2, U.S. Pat. No. 6,732,875, and U.S. Pat. No. 7,156,251.

Such a lid is subject to several requirements, some of which contradict each other. Primarily, the lid should guarantee that it remains fluid tight, even under adverse conditions, such as the corresponding container falling down onto the floor from a height of one meter or more. For this purpose, not only the material of the lid should be liquid proof, but the lid should remain fixedly mounted on the container, and the lid should not have a tendency to break. Further, since it is an article for mass use, in particular in fast food restaurants, it is mandatory that the lid may be produced at very reasonable costs. In addition, the lid should be easily operable for the restaurant staff. Similarly, a reclosable lid as contemplated herein should also be easily and intuitively operable for the end user.

OBJECT OF THE INVENTION

During use, it has turned out that the conventional reclosable lid is not able to comply with all these contradicting requirements in a satisfactory way. Therefore, it is the object of the present invention to provide a lid for a container that is able to comply with the above-mentioned requirements to the best possible degree. In particular, the container lid should be producible in a cost efficient way without compromising properties such as stability and liquid-proofness.

This object is achieved with a lid that is detachably mountable onto the edge of an opening of the container and having an upper lid part and a lower lid part, the lower lid part (3) including a circumferential mounting flange (4) for overlapping the opening edge of the container, and the upper lid part (2) including a circumferential mounting flange (25) for overlapping the mounting flange (4) of the lower lid part (3).

In comparison to the conventional double lid, the reclosable double lid of the present invention is improved in several ways. In contrast to the conventional lid, both the upper lid part and the lower lid part of the lid according to the present invention overlap the opening edge of the container. This circumstance considerably enhances the liquid-proofness or spill-proofness of the lid. Even if one of the two lid parts should inadvertently not be held securely enough on the container, a secure fastening of the complete lid will still be ensured by the other lid part. Also, again in contrast to the conventional device, the liquid may no longer enter into the gap between the upper and lower lid part, thereby reducing the risk of liquid leaking out of the consumption opening. Stability of the lid is enhanced due to both the upper and the lower lid part completely covering the opening of the container. The same circumstance will also improve the thermal insulation properties—again in contrast to the conventional lid in which two walls are adjacent to each other only in certain, restricted portions of the lid.

SUMMARY OF THE INVENTION

In a particularly simple embodiment, the outer circumference of the mounting flanges of the upper and lower lid parts are circular and have the same circle diameter. In this way, the lid will conform with a circular opening of the container. However, the circumferences of the mounting flanges may have any other desired shape.

In an advantageous embodiment, the outlet openings of the upper lid part and of the lower lid part are each arranged in a plane that is parallel to the plane defined by the lower edge of the mounting flange of the respective lid part. On the other hand, in a different embodiment, the plane in which the outlet openings lie can be sloped with reference to the plane defined by the lower edge of the mounting flange of the respective lid parts.

The distances of the planes defined by the lower edges of the mounting flanges of the respective lid parts from the planes, in which the respective outlet opening is located, may be identical between the upper lid part and the lower lid part. This will ensure an interference fit of the area around the outlet opening on the lower lid part with the area around the outlet opening of the upper lid part, thereby preventing leakage in this area. Alternatively, the above defined distance may be slightly smaller or larger than the corresponding distance at the other lid part. In particular, the respective distances may differ by the material thickness of the lower lid part, thereby ensuring that the lower lid part may remain in a plane contact with the upper lid part around the outlet openings.

Stability of the lid may be enhanced by the upper lid part and/or the lower lid part comprising a dome-shaped lid area.

Preferably, the upper lid part and the lower lid part comprise cooperating sliding guide means that fulfill two advantageous functions. First, the sliding guide means are adapted for rotatably mounting the upper lid part on the lower lid part. Second, the sliding guide means have the function of holding the upper lid part and the lower lid part in their assembled position by creating a force that prevents the detachment of the upper lid part from the lower lid part.

For example, the sliding guide means may comprise at least one projecting tongue on one of the two lid parts, and for each tongue an associated and cooperating groove on the other of the two lid parts. During the rotational movement of the upper lid part, the tongues may slide within the grooves.

Preferred areas for arranging the sliding guide means are the mounting flanges of the two lids parts and/or the adjacent, lateral portions of the dome-shaped lid areas of the two lid parts.

In a particular embodiment, the tongues are shorter than the associated grooves, and the rotational movement of the upper lid part relative to the lower lid part is restricted by means of one or several tongues being stopped at the ends of the associated grooves. Such an end stop for the rotational movement of the upper lid part facilitates handling of the lid for the user, as he receives a tactile feedback when the rotatable upper lid part reaches one of its end positions.

The lid may further be improved by a plurality of latch knobs or projections being provided on the inner side of the mounting flange of the lower lid part for latching the lower lid part onto the opening edge of the container. In particular, the latch knobs may be adapted for a snap fit engagement of the mounting flange of the lower lid part onto the container. Instead of a plurality of individual latch knobs, the mounting flange of the lower lid part may also have a latch projection over its entire internal circumference.

If latch knobs are provided, adjacent latch knobs may be spaced from each other by means of a web projecting from the outer side of the lower lid part. This web may facilitate the fitting of the upper lid part onto the lower lid part during assembly of the lid, as the upper lid part may slide on the webs. Further, the webs enhance the stability of the mounting flange of the lower lid part.

The top surface of the lower lid part may have a concave shape, which will offer two advantages. First, the concave shape may lead to an increased air gap between the upper lid part and the lower lid part, thereby enhancing the thermal insulating properties of the lid. Second, the concave shape may facilitate the collection of liquid that has found a way into the space between the upper and lower lid parts.

Preferably, a drop opening is arranged in the top surface of the lower lid part in order to allow the liquid collected between the upper and lower lid parts to drop back into the container, thereby further reducing the risk of leakage.

In order to further improve this function, drain channels guiding towards the drop opening may be provided on the upper surface of the lower lid part. In particular, these drain channels may lead from the area around the outlet opening towards the drop opening.

If desired, projecting ribs may be provided on the outer surface of the upper lid part. These projecting ribs may facilitate handling of the lid for the user, in particular by allowing the user to more easily grip and rotate the upper lid part on the lower lid part. Further, the ribs may ensure that a plurality of lids cannot be stacked too closely. This so-called "de-nesting" property will facilitate the detachment of one assembled lid from the other, thereby facilitating the handling of the lid for restaurant staff.

Tests have shown that it is advantageous to provide the ribs in groups of several ribs each in order to present larger areas for being gripped by the user.

If tongues are provided on the upper lid part, the ribs may preferably be arranged on the sections between the tongues.

In an advantageous embodiment of the invention, the outlet openings of the upper lid part and/or of the lower lid part are arranged on a protuberance that projects relative to the other areas of the respective lid part. In particular, this protuberance may project in an axial direction from the remainder of the top surface of the lid. The protuberance will help the user to identify the location of the outlet opening, even if the latter is closed. Moreover, the user will find it considerably easier to drink from the container if the outlet opening is provided on such a protuberance.

It is preferred that the protuberances each have the form of a section of a circular arc. This circular arc should be curved around the center of rotation of the upper lid part relative to the lower lid part, thereby ensuring that the protuberance of the upper lid part is securely guided on the protuberance of the lower lid part during rotation of the upper lid part.

In a specific embodiment, the protuberance of the upper lid part has a greater length in the circumferential direction than the protuberance of the lower lid part, and the rotational movement of the upper lid part relative to the lower lid part is restricted by the protuberance of the lower lid part engaging with the inner ends of the protuberance of upper lid part. In this way, the user will receive a strong tactile feedback if the upper lid part reaches one of the two rotational end positions.

Preferably, the rotational angle restricted by the protuberances corresponds substantially with the rotational angle defined by the engagement of the tongues with the grooves. Provided that the protuberances and the cooperating tongues and grooves are arranged at a correct circumferential position relative to each other, the rotational movement of the upper lid part will be stopped in both directions by several stop means.

In order to considerably enhance the thermal insulating properties of the lid, an air gap may be present in at least part of the area between the upper lid part and the lower lid part in the assembled position of the lid. In particular, such an air gap may be present over the major part of this area. In particular in connection with a double wall container, a lid configured in this way may securely prevent the escape of heat from the liquid in the container. Simultaneously, this configuration will prevent the outer surface of the upper lid part from coming into contact with the hot liquid (e.g. tea, coffee, or the like) within the container and thus becoming too hot for being touched by the user.

The highest thermal insulating properties may be achieved if, in the assembled position of the lid, the upper lid part and the lower lid part are in contact with each other only in the area of the mounting flanges, in the area of the protuberances, and/or at the cooperating tongues and grooves.

DESCRIPTION OF THE DRAWINGS

Advantageous and preferred embodiments of the invention will now be described with respect to the accompanying drawings. In particular.

Like elements and components are referred to throughout all drawings by like reference numerals.

DETAILED DESCRIPTION

Figure 1:
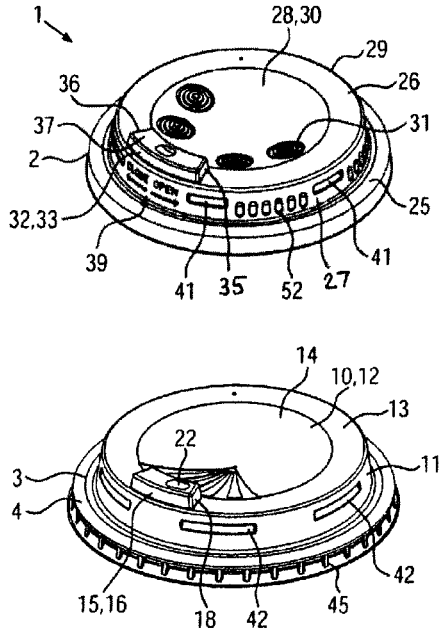
FIG. 1 shows a perspective view of the lid parts of a lid according to the present invention in their disassembled position.

FIG. 1 shows a perspective view of an embodiment of a lid 1 of the present invention. The lid 1 comprises an upper lid part 2 and a lower lid part 3, which are shown in FIG. 1 in their disassembled position.

The lower lid part 3 comprises a circumferential mounting flange 4, by which the lower lid part 3—with or without the upper lid part 2 assembled on the lower lid part 3—may be mounted on the edge of a container, in particular a drink container such as a paper cup. With respect to the details of such mounting, attention is drawn e.g. to EP 1 787916 A 1 or EP 1 367 001 A 1, although these documents disclose unitary lids that are not reclosable.

As shown in more detail in FIGS. 2 to 4, the mounting flange 4 of the lower lid part 3 comprises an (optional) horizontal section 5, a curved section 6 corresponding to the curvature of the rolled edge of the paper cup (not shown), a constriction 7 with a smaller radial distance from the central axis of the lower lid part 3 than the remainder of the curved section (this constriction 7 being intended to snap fit below the opening edge of the container), an inclined section 8, and eventually a lower horizontal section 9.

In addition to the mounting flange 4, the lower lid part 3 comprises a central, dome-shaped lid area 10 with a lateral wall 11 and a top surface 12. The top surface 12 comprises a generally horizontal, annular portion 13. The annular portion 13 surrounds a concave or depressed portion 14 of the top surface 12.

Figure 6:
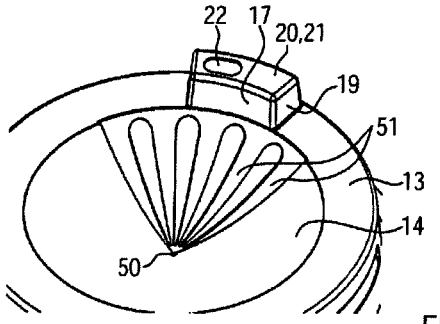
FIG. 6 shows an enlarged view of the top surface of the lower lid part.

A protuberance 15 projects from the annular portion 13 of the top surface 12. In a top view, the protuberance 15 has the shape of a segment of a circular arc that is centered on the symmetry axis A of the lower lid part 3. The protuberance 15 comprises an outer lateral wall 16, an opposite inner lateral wall 17 (c.f. FIG. 6), a first end wall 18, a second end wall 19 (c.f. FIG. 6), and a top wall 20. The top wall 20 is generally planar and comprises a first, closed section 21 and a second section with an outlet opening 22.

Figure 7:
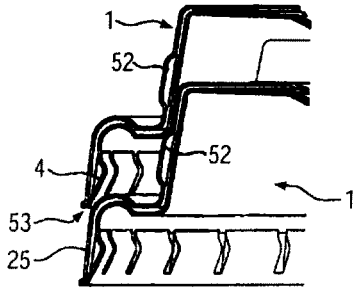
FIG. 7 shows two assembled lids in a stacked relationship.

The upper lid part 2 has another mounting flange 25. As shown in FIGS. 6 to 7, the mounting flange 25 is adapted to overlap the mounting flange 4 of the lower lid part 3 in the assembled position of the lid 1. In addition to the mounting flange 25, the upper lid part 2 has a central, dome-shaped lid area 26 that generally conforms in its contour with the dome shaped lid area 10 of the lower lid part 3. In particular, the dome-shaped lid area 26 of the upper lid part 2 comprises a lateral wall 27 and a top surface 28. The top surface 28 comprises a generally horizontal annular portion 29 surrounding a circular, concave or depressed portion 30.

The concave portion 30 carries a plurality of convex, invertible portions 31. These convex portions may be depressed and, thus, turned into concave portions by the restaurant staff in order to indicate the type of beverage presently held by the container covered by the lid 1.

Like the annular portion 13 of the lower lid 3, the annular portion 29 of the upper lid 2 carries a protuberance 32. In a top view, the protuberance 32 has the shape of a section of a circular arc. The protuberance 32 has an outer lateral wall 33 and an opposite inner lateral wall 34, both of which are curved around the symmetry axis of the upper lid part 2, i.e. the axis A of the rotation of the upper lid part 2 relative to the lower lid part 3. Further, the protuberance 32 comprises a first end wall 35, an opposite second end wall 36, and a top wall 37. The top wall 37 is generally planar and horizontal. In its central part, the top wall 37 is provided with an outlet opening 38 that is identical in shape and dimensions to the outlet opening 22 of the lower lid part 3.

As discussed in more detail below with respect to FIG. 5, the protuberance 32 of the upper lid part 2 is configured to sit tightly on the protuberance 15 of the lower lid part 3, such that the outer lateral walls 16 and 33, the inner lateral walls 17 and 36, and the top walls 20 and 37, respectively, are in a constant planar contact. In a circumferential direction, however, the protuberance 32 on the upper lid part 2 has a greater length than the protuberance 15 of the lower lid part 3. This allows the upper lid part 2 to be rotated with respect to the lower lid part 3 between two positions in which either the first end walls 18, 35 or the second end walls 19, 36 abut on each other. In this way, the end walls 18, 19 of the protuberance 15 of the lower lid part 3 function as end stops for the rotational movement of the upper lid part 2. Simultaneously, the curved protuberance 15 of the lower lid part 3 acts like a rail for guiding the curved protuberance 32 of the upper lid part 2, thereby guiding the rotational movement of the upper lid part 2 on the lower lid part 3. During this rotational movement, the lower lid part 3 remains in a fixed position on the container, and the upper lid part 2 rotates relative to the container and the lower lid part 3.

In the first rotational end position of the upper lid part 2, i.e. when the first end walls 18, 35 of the protuberances 15, 32 contact each other, the outlet opening 38 of the upper lid part 2 rests against the closed section 21 of the top wall 20 of the protuberance 15 of the lower lid part 3. In particular, there is no overlap between the outlet openings 22, 38 in this position. Therefore, the lid 1 is completely closed, and no liquid can escape through the lid 1 from the container.

From this first position, the upper lid part 2 can be rotated counterclockwise with respect to the lower lid part 3 in order to bring the lid 1 from its closed to its opened position—as indicated by corresponding indicators "close/open" 39 on the lateral wall 27 of the upper lid part 2. In this second end position, Le. when the second end walls 19, 36 of the protuberances 15, 32 contact each other, the outlet or consumption openings 22, 38 of the two lid parts 2, 3 are aligned with each other. Since the outlet openings 22, 38 have identical shape and dimensions, the resulting consumption opening through the lid 1 has the same shape and size as each of the two outlet openings 22, 38. The user may now consume the beverage from the container through the resulting consumption opening. Subsequently, the lid 1 may be brought into its closed position again by rotating the upper lid part 2 clockwise with respect to the lower lid part 3.

Figure 2:
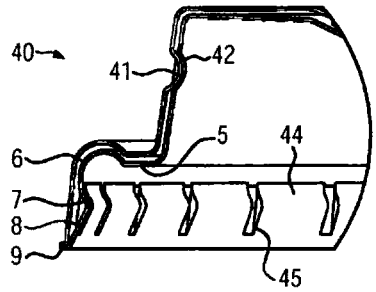
FIG. 2 shows a partial vertical section through a first embodiment of upper and lower lid parts of the present invention in their assembled positions.

When the two lid parts 2,3 are in their assembled position, cf. FIGS. 2 to 5, the rotational movement of the upper lid part 2 on the lower lid part 3 is further guided by sliding guide means 40 being provided on both lid parts 2, 3. In the first embodiment, as shown in FIGS. 1 and 2, the sliding guide means 40 are provided on the lateral surfaces 11, 27 of the dome shaped lid areas 10, 26 of the two lid parts 2, 3. In this embodiment, the sliding guide means 40 comprise a plurality of spaced apart depressions or tongues 41 projecting inwardly from the lateral wall 27 of the dome-shaped lid area 26 of the upper lid part 2. These tongues 41 are in engagement with and cooperating with corresponding depressions or grooves 42 on the lateral surfaces 11 of the dome-shaped lid area 10 of the lower lid part 3. These grooves 42 are depressed inwardly from the lateral surfaces 11 and correspond in number to the number of tongues 41 on the upper lid part 2.

As shown in FIG. 1, the tongues 41 have a shorter length than the corresponding grooves 42. This will allow the tongues 41 to slide in the grooves 42 until reaching one of the two ends of the grooves 42, which will then prevent any further rotation of the upper lid part 2 with respect to the lower lid part 3. Preferably, the sliding guide means 40 and the protuberances 15, 32 of the two lid parts 2, 3 are adapted to both allow the same rotational angle of the upper lid part 2 with respect to the lower lid part 3. For this purpose, the tongues 41 and grooves 42 are positioned and dimensioned such that the tongues 41 abut on a first end of the corresponding grooves 42 when the two first end walls 18, 35 of the protuberances 15, 32 are in contact, and to abut on the opposite end of the grooves 42 when the two second end walls 19, 36 of the protuberances 15, 32 engage with each other.

In addition to guiding the rotational movement of the upper lid part 2 on the lower lid part 3, the sliding guide means 40 fulfill a second function, namely to hold the two lid parts 2,3 in their assembled position. For this purpose, the tongues 41 are adapted to snap fit into the grooves 42 when the lower lid part 3 is pushed into the upper lid part 2.

Figure 3:
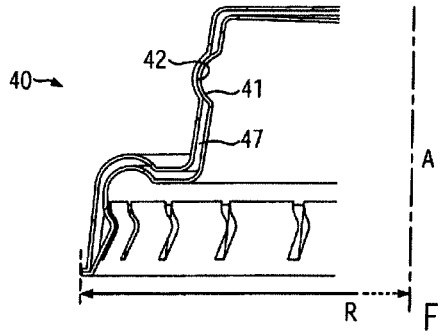
FIG. 3 shows a partial vertical section through upper and lower lid parts of a second embodiment in their assembled position.

In the second embodiment, as shown in FIG. 3, the arrangement and orientation of the tongues 41 and grooves 42 is inverted. In this embodiment, the tongues 41 are provided on the lower lid part 3, projecting outwardly from the lateral surface 11 of the dome-shaped lid area 10. They cooperate with grooves 42 on the internal surface of the lateral wall 27 of the dome-shaped lid area 26 of the upper lid part 2.

Figure 4:
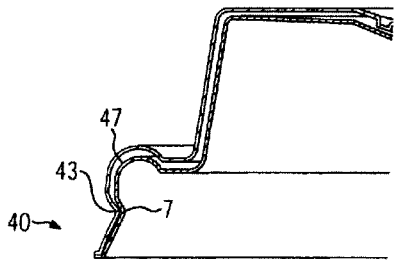
FIG. 4 shows a partial vertical section through upper and lower lid parts of a third embodiment in their assembled position.

In the third embodiment, as shown in FIG. 4, the sliding guide means 40 are constituted by an inwardly projecting constriction 43 on the mounting flange 25 of the upper lid part 2 cooperating with the inwardly projecting constriction 7 on the mounting flange 4 of the lower lid part 3. In each of these embodiments, the sliding guide means 40 serve to both guide the rotational movement of the upper lid part 2 on the lower lid part 3, and to hold the two lid parts 2, 3 together in their assembled position by means of a snap fit engagement.

The complete lid 1, on the other hand, may be releasably mounted on the opening edge of a container. In particular, the constriction 7 on the mounting flange 25 of the lower lid part 3 corresponds to a plurality of equidistance latch knobs 44 on the inside of the mounting flange 4. These latch knobs 44 may snap fit below a curved or rolled rim of the opening edge on the container, holding the rim of the container in the curved section 6 of the mounting flange 4.

As shown in FIGS. 1 and 2, a plurality of webs 45 is provided between the latch knobs 44. These webs 45 project on the outer surface of the mounting flange 4. They increase the stability of the mounting flange 4 and facilitate the sliding of the upper lid part 2 onto the lower lid part 3 when the two lid parts 2, 3 are brought into their assembled position.

Figure 5:
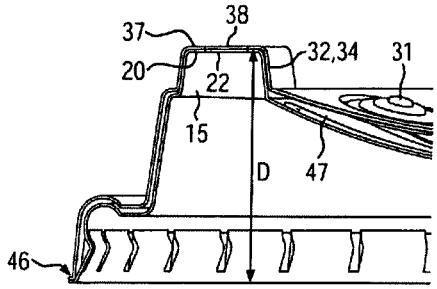
FIG. 5 shows a partial vertical section through upper and lower lid parts of the first or second embodiment at the position of the outlet openings.

FIG. 5 shows a partial sectional view of an assembled lid 1 in the area of the protuberances 15, 32. As discussed above, the protuberances 15, 32 are shaped and dimensioned such that their outer lateral walls 16, 33, their inner lateral walls 17, 34, and their top walls 20,37 are in a constant planar contact, respectively. In this way, the protuberance 15 of the lower lid part 3 may act as a rail supporting the protuberance 32 of the upper lid part 2 in order to guide the rotational movement of the upper lid part 2. Simultaneously, the planar engagement between the surfaces will prevent the intrusion of liquid between the protuberances 15, 32, in particular between their top walls 20, 37. Hence, the area around the outlet opening 22 of the lower lid part 3 is sealed, the undesired leakage of liquid is prevented, and the complete lid 1 is spill-proof when the outlet opening 22 of the lower lid part 3 is closed.

The planar contact between the top walls 20, 37 of the protuberances 15, 32 is achieved by the two top walls 20, 37 both being arranged in a plane with substantially the same distance D from the lower edges or lower horizontal sections 9 of the respective mounting flanges 4, 25. Since, as shown in FIG. 5, the lower horizontal section 46 of the upper lid part 2 rests on the lower horizontal section 9 of the lower lid part 3, the top walls 20,37 of the protuberances 15. 32 in FIG. 5 both have exactly the same distance D from the plane defined by lower edges of the respective lid parts 2, 3. Therefore, a particular high degree of spill-proofness may be achieved if the top walls 20, 37 of the protuberances 15, 32 are in an interference fit, with the top wall 20 of the protuberance 15 of the lower lid part 2 being constantly pressed against the top wall 37 of the upper lid part 2. Attention must be drawn to the fact that in a different embodiment, the plane which contains both top walls 20, 37 can be sloped with reference to the plane defined by the lower edges 9, 46 of the mounting flanges of the respective lid parts 2, 3, without affecting the spill-proofness feature of the present lid 1.

As shown in the vertical sections in FIGS. 2 to 5, the upper and lower lid parts 2, 3 are in contact with each other merely at the lower horizontal sections 9, 46 of their mounting flanges 4, 25, at the protuberances 15, 32, and at the sliding guide means 40. In all remaining portions, i.e. over the major part of the vertical section, an air gap 47 is created between the two lid parts 2, 3. This air gap 47 significantly enhances the thermal insulating properties of the lid 1. Moreover, if the container with the lid 1 is inclined for the purpose of drinking from the container, the air gap 47 creates a distance between the upper lid part 2 and the hot beverage in the container, thereby keeping the temperature of the upper lid part 2 low enough in order not to irritate the user, in particular his temperature sensitive lips.

As further shown in FIGS. 2 to 5, both lower horizontal sections 9, 46 of the two lid parts 2, 3 terminate at the same radial distance R from the symmetry axis A of the lid 1, i.e., from the axis A of rotation of the upper lid part 2 relative to the lower lid part 3. As evident from FIG. 5, the two outlet openings 22, 38 of the two lid parts 2, 3 are arranged at an identical radial distance from the rotational axis A.

FIG. 6 shows an enlarged view of the top surface 12 of the dome-shaped lid area 10 of the lower lid part 3. At the deepest point of the concave portion 14 of the top surface 12, i.e. at the center of the concave portion 14, a drain opening or drop opening 50 is provided. This drop opening 50 allows liquid collected in the concave portion 14 to drop back into the container. By reducing the amount of liquid between the two lid parts 2, 3, the undesired leakage of liquid between the two lid parts 2, 3 can be prevented more efficiently.

A plurality of converging drain channels 51 is provided on the concave portion 14, these drain channels 51 converging and leading towards the drop opening 50. In particular, the drain channels 51 are provided in the section between the drop opening 50 and the protuberance 15 of the lower lid part 2. In a top view, the drain channels 51 are provided in a section with an angle of 90°, i.e. covering a quarter of the concave portion 14.

The outlet or consumption opening 22 of the lower lid part 3 is shown in FIG. 6 with an oval shape. However, the outlet opening 22 may also be circular, rectangular, or have any other desired shape.

FIG. 7 shows two assembled lids 1 in a stacked one on top of the other condition. As shown in FIG. 7, the lower edge of the dome-shaped lid area 10 of the lower lid part 3 of the upper lid 1 rests on ribs 52 projecting outwardly from the lateral walls 27 of the dome shaped lid area 26 of the upper lid part 2 of the lower lid 1. This will ensure that the two lids 1 are not pressed into each other too tightly, thereby facilitating the detachment of one lid 1 from the other, and preventing deformation thereof. As shown in FIG. 7, the ribs 52 are provided at such a position that, in the stacked position of the two lids 1, a gap 53 remains between the mounting flange 4 of the upper lid 1 and the mounting flange 25 of the lower lid 1. This gap 53 allows air to flow between the two stacked lids 1, thereby preventing the creation of a low pressure between the two lids 1 during the detachment, which would otherwise require a higher force for the detachment.

As shown in FIG. 1, the ribs 52 are arranged in groups of, for example, six ribs each. These groups of ribs 52 are located between the tongues 41. The outwardly projecting ribs 52 not only facilitate stacking and de-nesting of assembled lids 1, but they also serve as gripping means for the user. In particular, the ribs 52 enable the user to more easily exert a twisting force onto the lid 1 in order to rotate the upper lid part 2 relative to the lower lid part 3.

The invention clamed is:

1. A container lid, comprising:

a lower lid part having an inner outlet opening and a circumferential mounting flange, and an upper lid part having an outer outlet opening and a circumferential mounting flange for overlapping the mounting flange of the lower lid part, when the upper lid part and the lower lid part are in an assembled position, the upper lid part is rotatable relative to the lower lid part between at least two positions, such that the outlet openings are mutually aligned in one position and are without any overlap in the other position, the outlet openings of the upper lid part and the lower lid part are arranged on a protuberance which projects relative to the other areas of the respective lid part;

the protuberances are in engagement with each other in the assembled position of lower lid part and upper lid part;

the protuberances each have the form of a section of a circular arc; and wherein the protuberance of the upper lid part has a greater length in the circumferential direction than the protuberance of the lower lid part, and the rotational movement of the upper lid part relative to the lower lid part is restricted by the protuberance of the lower lid part engaging with the inner ends of the protuberance of the upper lid part.

2. A container lid according to claim 1, wherein the outer perimeter of the mounting flange of the upper lid part has the same shape and dimensions as the outer perimeter of the mounting flange of the lower lid part.

3. A container lid according to one of claim 1 wherein the outer perimeter of the mounting flange of the upper lid part and the outer perimeter of the mounting flange of the lower lid part are circular and have the same diameter.

4. A container lid according to claim 1, wherein the outlet opening of the upper lid part has the same shape and dimensions as the outlet opening of the lower lid part and both are at the same distance from the center of the lid.

5. A container lid according to claim 2 wherein the outlet openings of the upper lid part and of the lower lid part are arranged in the same plane relative to the plane defined by the lower edge of the mounting flange of the respective lid part.

6. A container lid according to claim 2, wherein the distance of the plane defined by the lower edge of the mounting flange of the respective lid part from the plane in which the respective outlet opening is located, is substantially identical at the upper lid part to the respective distance at the lower lid part.

7. A containerlid according to claim 2 wherein the upper lid part and/or the lower lid part comprises a dome-shaped lid area.

8. A container lid according to claim 2 wherein the upper lid part and the lower lid part comprise cooperating sliding guide means for rotatably mounting the upper lid part on the lower lid part, and for holding the upper lid part and the lower lid part in their assembled position.

9. A container lid according to claim 8, wherein the sliding guide means comprises at least one projecting tongue on one of the two lid parts, and for each tongue an associated and cooperating groove on the other of the two lid parts.

10. A container lid according to claim 8, wherein the sliding guide means are arranged at the mounting flanges of the upper and lower lid parts and/or at the adjacent, lateral portions of one or more dome-shaped lid areas of the upper and lower lid parts.

11. A container lid according to claim 2 further comprising tongues that are shorter than one or more associated grooves, and wherein the rotational movement of the upper lid part relative to the lower lid part is restricted by means of one or several tongues being stopped at the ends of the associated grooves.

12. A container lid according to claim 2 wherein a plurality of latch knobs are provided on the inner side of the mounting flange of the lower lid part.

13. A container lid according to claim 12, wherein adjacent latch knobs are spaced from each other by means of a web projecting from the outer side of the lower lid part.

14. A container lid according to claim 2 wherein the top surface of the lower lid part comprises a concave portion.

15. A container lid according to claim 2 wherein a drop opening is arranged in the top surface of the lower lid part.

16. A container lid according to claim 15, wherein drain channels for guiding fluid towards the drop opening are provided on the top surface of the lower lid part.

17. A container lid according to claim 2, wherein projecting ribs are provided on the outer surface of the upper lid part.

18. A container lid according to claim 17, wherein the ribs are provided in groups containing a plurality of ribs in each group.

19. A container lid according to claim 17 wherein the ribs are arranged on the sections between the tongues.

20. A container lid according to claim 1 wherein, a rotational angle restricted by the protuberances corresponds substantially with rotational angle defined by the engagement of one or more tongues with one or more grooves.

21. A container lid according to claim 1 wherein in the assembled position of the lid, an air gap is present in at least part of the area between the upper lid part and the lower lid part.

22. A container lid according to claim 1 wherein, in the assembled position of the lid, the upper lid part and the lower lid part are in contact with each other only in the area of the mounting flanges, in the area of the protuberances, and/or at one or more cooperating tongues and one or more grooves.

23. A container lid according to claim 1 in combination with a paper cup.

24. A recloseable lid for a paper container which comprises a lower lid part having an inner outlet opening, and an upper lid part having an outer outlet opening, the upper lid part being rotatable relative to the lower lid part between a first position in which the outlet openings of the upper and lower lids are aligned with one another and a second position in which the outlet openings are not aligned when the upper and lower lid parts are mounted on the paper container, the lower lid part comprising a circumferential mounting flange for overlapping the opening edge of the paper container, and the upper lid part comprising a circumferential mounting flange for overlapping the mounting flange of the lower lid part when the upper and lower lids are mounted on and detachable from the paper container, wherein the outlet openings of the upper lid part and the lower lid part are arranged on a protuberance which projects relative to the other areas of the respective lid part, wherein the protuberances are in engagement with each other in the assembled position of lower lid part and upper lid part, wherein the protuberances each have the form of a section of a circular arc, and wherein the protuberance of the upper lid part has a greater length in the circumferential direction than the protuberance of the lower lid part, and the rotational movement of the upper lid part relative to the lower lid part is restricted by the protuberance of the lower lid part engaging with the inner ends of the protuberance of the upper lid part.

* * * * *